US006170291B1

(12) United States Patent
Hine

(10) Patent No.: US 6,170,291 B1
(45) Date of Patent: Jan. 9, 2001

(54) SEPARATION OF AIR

(75) Inventor: Christopher John Hine, Guildford (GB)

(73) Assignee: The BOC Group plc, Windlesham (GB)

( * ) Notice: Under 35 U.S.C. 154(b), the term of this patent shall be extended for 0 days.

(21) Appl. No.: 09/288,099

(22) Filed: Apr. 7, 1999

(30) Foreign Application Priority Data

Apr. 9, 1998 (GB) ..... 9807833

(51) Int. Cl.[7] ..... F25J 3/00
(52) U.S. Cl. ..... 62/646; 62/939
(58) Field of Search ..... 62/646, 939

(56) References Cited

U.S. PATENT DOCUMENTS

| | | | | |
|---|---|---|---|---|
| 3,210,948 | | 10/1965 | Schilling . | |
| 4,224,045 | | 9/1980 | Ziemer et al. . | |
| 4,817,393 | | 4/1989 | Erickson . | |
| 5,049,173 | * | 9/1991 | Cormier, Sr. et al. | 62/646 |
| 5,337,570 | | 8/1994 | Prosser . | |
| 5,379,599 | * | 1/1995 | Mostello | 62/646 |
| 5,437,161 | * | 8/1995 | Chretien | 62/646 |
| 5,564,290 | * | 10/1996 | Bonaquist et al. | 62/646 |
| 5,586,451 | | 12/1996 | Koeberle et al. . | |

FOREIGN PATENT DOCUMENTS

| | | |
|---|---|---|
| 422974 | 4/1991 | (EP) . |
| 558082 | 9/1993 | (EP) . |
| 624766 | 11/1994 | (EP) . |
| 438282 | 3/1996 | (EP) . |

* cited by examiner

*Primary Examiner*—Ronald Capossela
(74) *Attorney, Agent, or Firm*—Salvatore P. Pace

(57) ABSTRACT

Air is separated by rectification. The air is compressed in a main air compressor to a first pressure. Without further compression a first flow of the compressed air is cooled in a main heat exchanger to a temperature suitable for its separation by rectification. The first flow is introduced into the higher pressure column of a double rectification column comprising, in addition to the higher pressure column, a lower pressure column, in which a bottom oxygen fraction containing from about 50 to about 96 mole percent of oxygen is formed. A condenser-reboiler places the higher pressure column in heat exchange relationship with the lower pressure rectification column. A second flow of the compressed air is expanded with the performance of external work in an expansion turbine without further compression of the second flow upstream of the expansion. The expanded second flow is introduced into the lower pressure rectification column. An impure oxygen product is taken from the said bottom fraction. The external work is the generation of electrical power, and thus the turbine is coupled to an electrical generator.

10 Claims, 2 Drawing Sheets

SEPARATION OF AIR

BACKGROUND OF THE INVENTION

This invention relates to a method of and apparatus for the separation of air.

The separation of air by rectification is very well known indeed. Rectification is a method in which mass exchange is effected between a descending stream of liquid and an ascending stream of vapour such that the ascending stream of vapour is enriched in a more volatile component (nitrogen) of the mixture to be separated and the descending stream of liquid is enriched in a less volatile component (oxygen) of the mixture to be separated.

It is known to separate air in a double rectification column comprising a higher pressure rectification column which receives a stream of purified, compressed, vaporous air at a temperature suitable for its separation by rectification, and a lower pressure rectification column which receives a stream of oxygen-enriched liquid air for separation from the higher pressure rectification column, and which is in heat exchange relationship with the higher pressure rectification column through a condenser-reboiler, of which the condenser provides liquid nitrogen reflux for the separation and the reboiler provides an upward flow of nitrogen vapour in the lower pressure rectification column.

The double rectification column may be operated so as to produce an oxygen fraction at the bottom of the lower pressure column and a nitrogen fraction at the top of the lower pressure column. The oxygen fraction may be essentially pure, containing less than 0.5% by volume of impurities, or may be impure containing up to 50% by volume of impurities.

There is a net requirement for refrigeration to be provided to the air separation plant. At least part of this requirement arises from the operation of the double rectification column at cryogenic temperatures. Particularly if none of the products of the air separation is taken in liquid state, the requirements for refrigeration are typically met by raising the pressure of a part of the air to at least 2 bar above the operating pressure at the top of the higher pressure column and expanding it with the performance of external work in an expansion turbine which exhausts into the lower pressure column. Typically, the turbine is coupled to a booster-compressor which raises the pressure of the air to above that at the top of the higher pressure column.

An air separation plant typically consumes a considerable amount of power. Its is therefore desirable for the air separation plant to have a configuration which enables power consumption to be minimised without unduly increasing its capital cost. In order to minimise the power consumption much attention in the art has recently been focused upon operating the lower pressure rectification column with two reboilers, one operating at a higher temperature and being heated by a flow of the air to be separated, and the other operating at a lower temperature and being heated by a flow of nitrogen separated in the higher pressure rectification column. A disadvantage of such plant is that the requirement for a second reboiler adds to its capital cost.

U.S. Pat. No. 5,337,570 provides examples of a yet further kind of air separation plant. There is a first condenser-reboiler which condenses a part of the top nitrogen fraction separated in the higher pressure column. The condensation is effected by indirect heat exchange with a stream of a bottom oxygen-enriched liquid fraction formed in the higher pressure column. As a result, the stream of the bottom oxygen-enriched liquid fraction is partially reboiled. Resulting vapour and residual liquid are fed to the lower pressure rectification column. The plant employs a single generator-loaded expansion turbine exhausting into the lower pressure column. The air to be separated is compressed in a main, plural stage, compressor. The main air feed to the higher pressure rectification column is taken from a lower pressure stage than the feed to the expansion turbine.

It is an aim of the present invention to provide a method and apparatus for separating air by rectification which are able to be operated at a favourable net power consumption without imposing on the apparatus an unacceptably high capital cost and without the need to have two reboilers associated with the lower pressure rectification column.

SUMMARY OF THE INVENTION

According to the present invention there is provided a method of separating air by rectification, including compressing the air to a first pressure; without further compression cooling in a main heat exchanger a first flow of the compressed air to a temperature suitable for its separation by rectification and introducing the first flow into the higher pressure column of a double rectification column comprising, in addition to the higher pressure column, a lower pressure column, in which a bottom oxygen fraction having an oxygen content in the range of about 50 to about 96 mole percent is formed; expanding with the performance of external work a second flow of the compressed air; introducing the expanded second flow into the lower pressure column, and taking an impure oxygen product from the said bottom fraction, wherein the external work is the generation of electrical power, characterised in that the double rectification column additionally includes a condenser-reboiler placing the higher pressure column in heat exchange relationship with the lower pressure column, and the expansion of the second flow of the compressed air takes place without further compression of the second flow upstream thereof.

The present invention also provides apparatus for separating air by rectification, including a double rectification column comprising a higher pressure column and a lower pressure column, at least one air compressor for compressing the air to a first pressure, a main heat exchanger for cooling the first flow of the compressed air to a temperature suitable for its separation by rectification, an inlet to the higher pressure column for the first flow, an expansion turbine for expanding with the performance of external work a second flow of the compressed air having an inlet for the second flow of the compressed air and an outlet communicating with the lower pressure column, the expansion turbine being loaded by an electrical generator, and an outlet from the lower pressure column for an impure oxygen product formed of a bottom fraction having an oxygen content in the range of about 50 to about 96 mole percent, characterised in that there is no additional compression means for raising the pressure of either the said first flow or the said second flow of the compressed air above the first pressure, and the double rectification column additionally includes a condenser-reboiler able to place the higher pressure column in heat exchange relationship with the lower pressure column.

The method and apparatus according to the invention offer a number of advantages. First, they enable a particularly large proportion of the air to be expanded with the performance of external work and introduced into the lower pressure column. This makes it possible to operate the lower pressure column relatively efficiently and with a relatively low vapour traffic below the level at which the expanded air is introduced. In addition, the load on the condenser-reboiler is reduced. The effective diameter of the lower pressure column may be reduced in the lower part of the lower pressure column, thereby making possible a reduction in the total area of liquid-vapour contact surfaces. The size of the condenser-reboiler may also be reduced. Although operation of the method and apparatus according to the invention in such a manner has the effect of widening the temperature difference in the main heat exchanger between flow being cooled and flow being warmed, this disadvantage is more than compensated for by the relatively high efficiency with which the lower pressure column can be operated, particularly because a wider temperature difference in the main heat exchanger permits either the pressure drop in, or the heat transfer area per unit volume of the main heat exchanger to be reduced, or permits both these advantages to be obtained. Third, the conventional booster-compressor associated with the expansion turbine is eliminated. Fourth, the method and apparatus according to the invention are able to be used to export a significant amount of electrical power, thereby reducing the net power consumption. Typically, the oxygen product is withdrawn from the lower pressure rectification column in liquid state, is pressurised, and is vaporised in indirect heat exchange with a third flow of the compressed air which is at a second pressure higher than the first pressure. This heat exchange may be performed in the main heat exchanger or in a separate one. Such examples of the method and apparatus according to the invention are particularly suited to producing an oxygen product having an oxygen content in the range of about 70 to about 90 mole percent of oxygen, preferably in the range of about 75 to about 85 mole percent. In the preferred examples, preferably at least about about 22% by volume of the flow of air to be separated forms the expanded second flow, more preferably from about 23% to about 30% by volume thereof. In such examples, the first flow of compressed air typically constitutes less than about 45% by volume of the total flow of the air to be separated.

Alternatively, the oxygen product may be withdrawn from the lower pressure rectification column in vapour state, and, if desired, compressed to a desired delivery pressure downstream of being warmed to a non-cryogenic temperature in the main heat exchanger. In this case, there is no need to condense a third flow of the compressed air. As a result, it becomes possible to form the second flow of compressed air as an even greater proportion of the total flow of air to be compressed. For example, if the oxygen product contains from about 70 to about 90 mole percent of oxygen, typically at least about 40% of the total flow of air to be separated may form the second flow of compressed air.

Preferably, the expansion turbine has a ratio of inlet pressure to outlet pressure in the range of about 2.5:1 to about 3.5:1.

The method according to the present invention is particularly suited to the separation of air when no liquid products of the separation are taken or when the total production of liquid products is less than about 10%, preferably less than about 5%, more preferably less than about 2%, of the total production of the oxygen product.

Preferably, the first flow of compressed air is divided from the second flow thereof typically in the main heat exchanger rather than upstream thereof. In any event, the first and second flows are preferably denied from the said air compressor at the same pressure Preferably, the compressed air is purified upstream of the main heat exchanger.

The higher pressure column and the lower pressure column may both be constituted by one or more vessels in which liquid and vapour phases are countercurrently contacted to effect separation of the air, as, for example, by contacting the vapour and liquid phases on packing elements or on a series of vertically spaced trays or plates mounted within the vessel or vessels.

BRIEF DESCRIPTION OF THE DRAWINGS

The method and apparatus according to the invention will now be described by way of example with reference to the accompanying drawings, in which.

Like parts in the drawings are indicated by the same reference numerals.

DETAILED DESCRIPTION OF THE INVENTION

Figure 1:
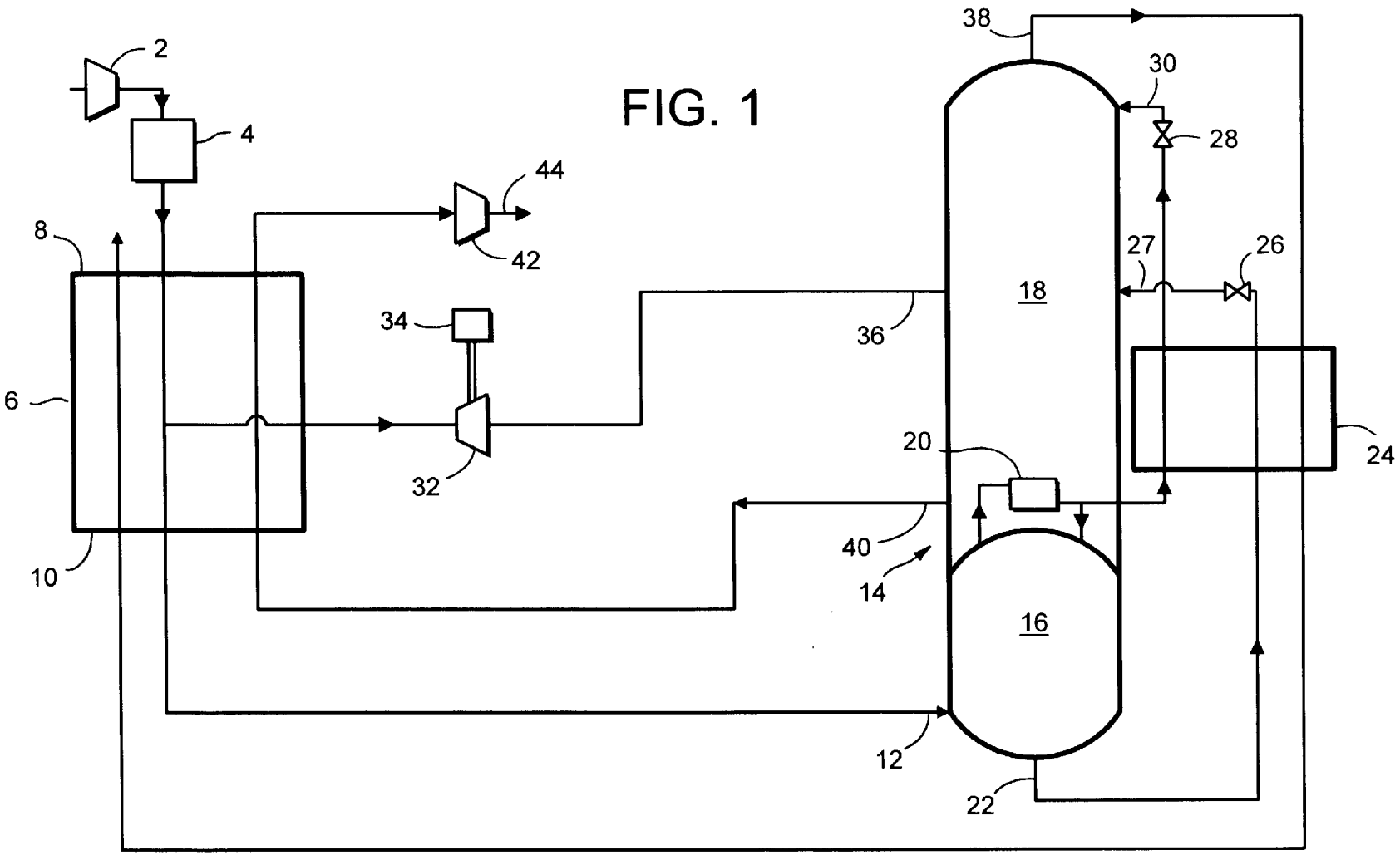
FIG. 1 is a schematic flow diagram of a first air separation apparatus according to the invention.

Referring to FIG. 1 of the drawings, a stream of air is compressed in a main air compressor 2. Heat of compression is extracted from the resulting compressed air in an after-cooler (not shown) associated with the main air compressor 2. The compressed air stream is purified in an adsorption unit 4. The purification comprises removal from the air flow of relatively high boiling point impurities, particularly water vapour and carbon dioxide, which would otherwise freeze in low temperature parts of the apparatus. The unit 4 may effect the purification by pressure swing adsorption or temperature swing adsorption. The unit 4 may additionally include one or more layers of catalyst for the removal of carbon monoxide and hydrogen impurities. Such removal of carbon monoxide and hydrogen impurities is described in EP-A-438 282. The construction and operation of adsorptive purification units are well known and need not be described further herein.

Downstream of the purification unit 4, the compressed air stream passes into a main heat exchanger 6 through its warm end 8. At an intermediate region of the main heat exchanger 6 the compressed air stream is divided into first and second flows. The first flow continues through the main heat exchanger 6 and leaves through the cold end 10 thereof at or close to its dew point and therefore at a temperature suitable for its separation by rectification. The first flow of compressed air passes from the cold end 10 of the main exchanger 8 through an inlet 12 into a lower region of a higher pressure column 16 forming a double rectification column 14 with a lower pressure column 18 and a (single) condenser-reboiler 20. (There is no other condenser-reboiler present placing the higher pressure column 16 in indirect heat exchange relationship with the lower pressure column 18.)

In operation, the air is separated in the higher pressure column 16 into a bottom oxygen-enriched liquid fraction and a top nitrogen vapour fraction. A stream of the oxygen-enriched liquid fraction is withdrawn from the bottom of the higher pressure column 16 through an outlet 22. The oxygen-enriched liquid air stream is sub-cooled in a further heat exchanger 24, is passed through a Joule-Thomson or throttling valve 26, and is introduced into a chosen intermediate region of the lower pressure column 18 through an inlet 27.

Nitrogen vapour flows from the top of the higher pressure column 16 into the condenser-reboiler 20 and is condensed therein by indirect heat exchange with a boiling impure liquid oxygen fraction at the bottom of the lower pressure column 18. A part of the resulting liquid nitrogen condensate is returned to the column 16 as reflux. The remainder of the condensate is sub-cooled by passage through the heat exchanger 24, is passed through a throttling or Joule-Thomson valve 28 and is introduced into the top of the lower pressure column 18 as reflux through an inlet 30.

The oxygen-enriched liquid air withdrawn from the higher pressure column 16 through the outlet 22 forms one source of the air that is separated in the lower pressure column 18. Another source of this air is the second flow of compressed air which is divided from the first flow of compressed air at an intermediate region of the main heat exchanger 6. The second flow of compressed air is withdrawn from the intermediate region of the main heat exchanger 6 and is expanded in an expansion turbine (sometimes referred to as a turbo-expander) 32 with the performance of external work. This external work is the operation of an electrical generator 34 to which the turbine 32 is coupled. The resulting expanded air leaves the turbine 32 at approximately the pressure of the lower pressure column 18 and is introduced into an intermediate region thereof through an inlet 38. The flows of air are separated in the lower pressure column 18 into a top nitrogen vapour fraction and a bottom impure liquid oxygen fraction typically containing from 70 to 90 mole percent of oxygen. The condenser-reboiler is effective to reboil the bottom impure liquid oxygen fraction by indirect heat exchange with the condensing nitrogen. A part of the resulting oxygen vapour ascends the column 18 and is contacted therein with downflowing liquid. The remainder of the impure oxygen vapour is withdrawn from the lower pressure column 18 through an outlet 40, is warmed to a non-cryogenic temperature, i.e. one a little below ambient, by passage through the main heat exchanger 6 from its cold end 10 to its warm end 8. The resulting warmed oxygen product is compressed to a desired delivery pressure in an oxygen compressor 42. The compressed oxygen product passes to an oxygen delivery pipeline 44. A nitrogen product (or waste) stream is taken from the top of the lower pressure column 18, is used to cool the heat exchanger 24, and, downstream of its passage therethrough, is passed through the main heat exchanger 6 from its cold end 10 to its warm end 8.

Figure 2:
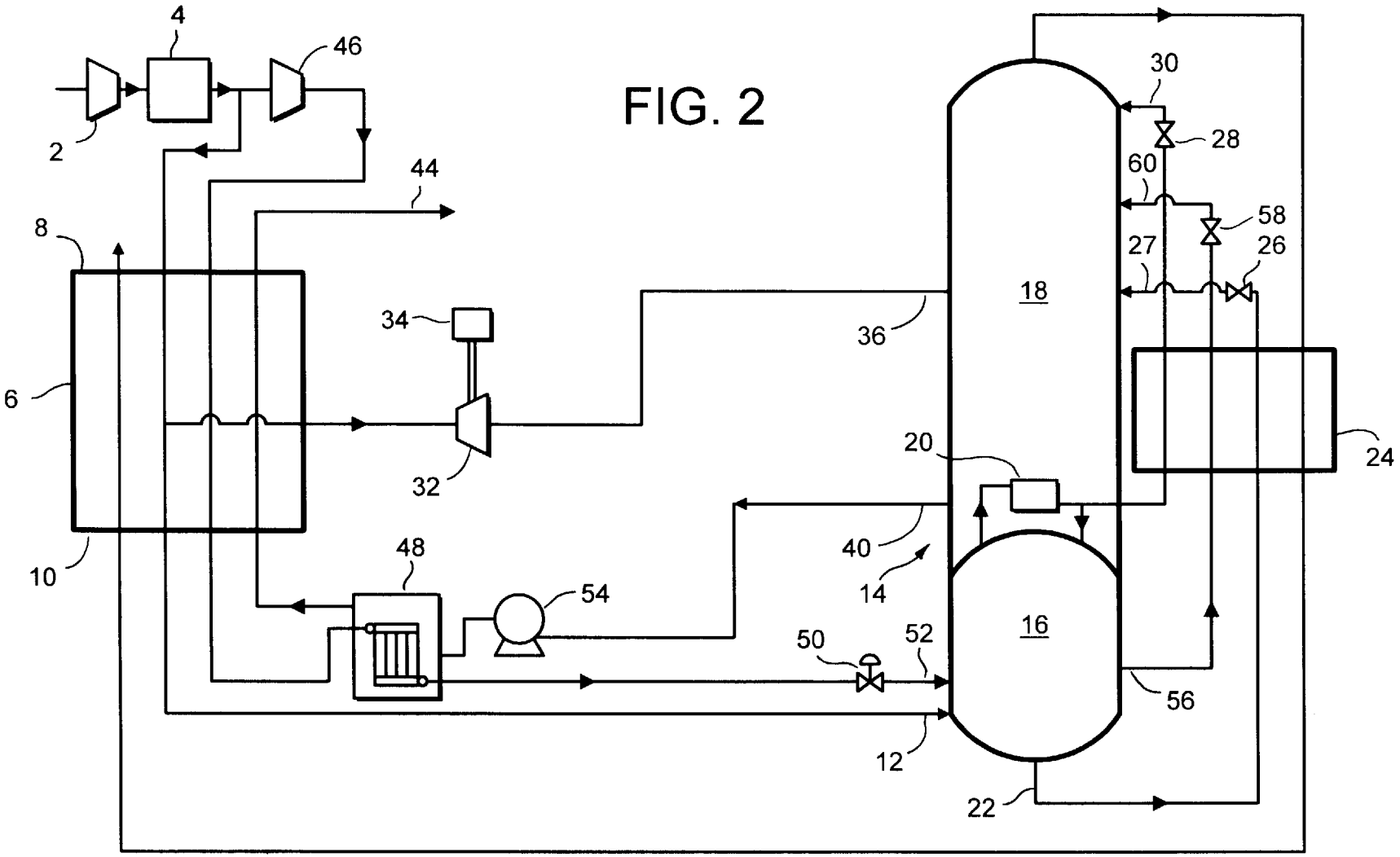
FIG. 2 is a schematic flow diagram of a second air separation apparatus according to the invention.

Referring now to FIG. 2 of the drawings, the plant shown therein is generally similar to that illustrated in FIG. 1 save that the oxygen product is withdrawn from the lower pressure column 18 through the outlet 40 in liquid state and is pressurised in a liquid pump 54 to a desired delivery pressure. A part of the purified air is taken from the purification unit 4 and is further compressed in a booster compressor 46. The resulting further compressed flow of air passes through the main heat exchanger 6 from is warm end 8 to its cold end 10 and is thereby cooled to its liquefaction point. The resulting cooled flow of further compressed air is condensed in a condenser-vaporiser 48 by indirect heat exchange with the pressurised flow of impure liquid oxygen product. As a result, the flow of impure liquid oxygen product is vaporised. The condensation of the air flowing through the condenser-vaporiser 48 is typically complete. The resulting condensate passed through a throttling or Joule-Thomson valve 50 and is introduced into the higher pressure column 16 through an inlet 52 at a level above that of the inlet 12. The oxygen vapour formed in the condenser-vaporiser 48 flows through the main heat exchanger 6 from its cold end 10 to its warm end 8 and thus passes to the product oxygen delivery line 44 at a desired pressure. Typically, a flow of liquid having approximately the same composition as that of air is withdrawn from an intermediate outlet 56 of the higher pressure column 16, is sub-cooled by passage through the heat exchanger 24, is passed through a throttling or Joule-Thomson valve 58 and is introduced through an inlet 60 into the lower pressure column 18. Alternatively, the flow of condensed liquid air may be divided upstream of the valve 50 and a part of the flow introduced into the lower pressure column 18 through a throttling or Joule-Thomson valve (not shown).

In a typical example of the operation of the apparatus shown in FIG. 2, the oxygen product withdrawn from the lower pressure column 18 through the outlet 40 may contain 80 mole percent of oxygen and may be raised to a pressure of about 4.3 bar in the pump 54. The turbine 32 has an inlet pressure of about 3.8 bar and an outlet pressure of about 1.25 bar. About 40% by volume of the total flow of air is introduced into the higher pressure column 16 through the inlet 12, about 25% by volume into the lower pressure column 18 through the inlet 16, and the remainder into the higher pressure column 16 through the inlet 52.

In the apparatuses shown in FIGS. 1 and 2 the main air compressor 2 sets the inlet pressure of the turbine 32 and the pressure of the inlet 12 of the higher pressure column 16. The air pressure at the inlet to the turbine 32 will be some parts of a bar less than the outlet pressure of the compressor 2 as a result of pressure drop through the purification unit 4 and the main heat exchanger 6. Similarly, the pressure at the inlet 12 to the higher pressure column 16 will be a few parts of a bar less than the outlet pressure of the main air compressor 2 as a result of pressure drop through the main heat exchanger 6 in the purification unit 4. Further, the expansion turbine 32 is the sole expansion turbine employed in both the apparatus shown in FIG. 1 and that shown in FIG. 2 of the drawings.

I claim:

1. A method of separating air by rectification, including:

compressing the air to a first pressure;

without further compression, cooling in a main heat exchanger a first flow of the compressed air to a temperature suitable for its separation by rectification and introducing the first flow into a higher pressure column of a double rectification column comprising, in addition to the higher pressure column, a lower pressure column, in which a bottom oxygen fraction having an oxygen content in the range of about 50 to about 96 mole percent is formed;

expanding with the performance of external work a second flow of the compressed air; and introducing the expanded second flow into the lower pressure rectification column, and taking an impure oxygen product from the said bottom fraction the external work being the generation of electrical power;

the double rectification column additionally including a condenser-reboiler placing the higher pressure column in heat exchange relationship with the lower pressure column, and the expansion of the second flow being performed without further compression of the second flow upstream thereof.

2. The method according 1, in which the oxygen product is withdrawn from the lower pressure column in liquid state, is pressurised, and is vaporised in indirect heat exchange with a third flow of the compressed air which is at a second pressure higher than the first pressure.

3. The method according to claim 2, in which the oxygen product has an oxygen content in the range of about 70 to about 90 mole percent.

4. The method according to claim 2, in which the oxygen product has an oxygen content in the range of about 75 to about 85 mole percent, and at least about 22% by volume of the flow of air to be separated forms the expanded second flow.

5. The method according to claim 4, in which from about 23% to about 30% by volume of the flow of air to be separated forms the expanded second flow.

6. The method according to claim 1, in which the second flow is expanded in an expansion turbine which has a ratio of inlet pressure to outlet pressure in the range of about 2.5:1 to about 3.5:1.

7. The method according to claim 1, in which no liquid products of the separation are taken.

8. The method according to claim 1, in which the first flow of compressed air is divided from the second flow thereof in the main heat exchanger.

9. An apparatus for separating air by rectification, including:

a double rectification column comprising a higher pressure column and a lower pressure column;

at least one air compressor for compressing the air to a first pressure;

a main heat exchanger for cooling the first flow of the compressed air to a temperature suitable for its separation by rectification;

an inlet to the higher pressure column for the first flow, an expansion turbine for expanding with the performance of external work a second flow of the compressed air and having an inlet for the second flow of the compressed air and an outlet communicating with the lower pressure column, the expansion turbine being loaded by an electrical generator; and an outlet from the lower pressure column for an impure oxygen product formed of a bottom fraction having an oxygen content in the range of about 50 to about 96 mole percent;

there being no additional compressor for raising the pressure of either the said first flow or the said second flow of the compressed air above the first pressure, and the double rectification column additionally including a condenser-reboiler placing the higher pressure column in direct heat exchange relationship with the lower pressure column.

10. The apparatus according to claim 9, additionally including a pump for withdrawing the oxygen product from the lower pressure column in liquid state and for raising its pressure, a heat exchanger for vaporising the pressurised oxygen product in indirect heat exchange with a third flow of the compressed air and a further compressor for raising, upstream of the heat exchange with the vaporising oxygen product, the pressure of the third flow of the compressed air.

* * * * *